US008989425B2

(12) United States Patent
Hua

(10) Patent No.: US 8,989,425 B2
(45) Date of Patent: Mar. 24, 2015

(54) EARPHONE

(71) Applicant: Zhigang Hua, Shenzhen (CN)

(72) Inventor: Zhigang Hua, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 14/093,741

(22) Filed: Dec. 2, 2013

(65) Prior Publication Data

US 2014/0153767 A1 Jun. 5, 2014

(30) Foreign Application Priority Data

Dec. 3, 2012 (CN) ..... 2012 2 0656808 U

(51) Int. Cl.
*H04R 25/00* (2006.01)
*H04R 1/28* (2006.01)
*H04R 1/10* (2006.01)

(52) U.S. Cl.
CPC ..... *H04R 1/2803* (2013.01); *H04R 1/1091* (2013.01); *H04R 1/10* (2013.01); *H04R 2460/13* (2013.01)
USPC ..... 381/373; 381/370; 381/380

(58) Field of Classification Search
CPC .... H04R 1/10; H04R 2205/022; H04R 1/105; H04R 5/0335; H04R 2201/10; H04R 2460/13; H04R 1/1016
USPC ..... 381/370–374, 376, 379–382
See application file for complete search history.

(56) References Cited

U.S. PATENT DOCUMENTS 5,867,582 A * 2/1999 Nagayoshi ..... 381/370
5,949,896 A * 9/1999 Nageno et al. ..... 381/380
6,668,064 B1 * 12/2003 Lin ..... 381/380

* cited by examiner

*Primary Examiner* — Suhan Ni
(74) *Attorney, Agent, or Firm* — IPro, Inc.; Na Xu

(57) ABSTRACT

An earphone is disclosed. The earphone includes a housing forming a volume, a plurality of sound holes arranged in the housing, a sound generator received in the volume of the housing and cooperatively with the housing forming a front volume, a supporter accommodated in the volume of the housing and engaging with the sound generator forming a main back volume, and cooperatively with the housing forming a auxiliary back volume. The supporter includes bottom, a sidewall upwardly extending from the bottom and an acoustic pipe, the acoustic pipe communicating the main back volume with the auxiliary back volume for balancing an internal acoustic pressure of the earphone.

16 Claims, 3 Drawing Sheets

EARPHONE

FIELD OF THE INVENTION

The present disclosure generally relates to the art of acoustic transducer components, and more particularly to an earphone for being capable of improving acoustic characteristics thereof in multiple audio frequency ranges.

DESCRIPTION OF RELATED ARTS

An electronic device may be provided with micro-speaker means. Such electronic devices may comprise mobile communication devices or terminals, such as user equipment, a cellular phone, a personal digital assistant (PDA) and so on, or other electronic devices, such as a laptop computer, a sound recorder or a sound player.

Generally, a related earphone according to the prior art has a housing with a driver unit accommodated therein, the driver comprising a magnetic circuit and a vibration system constituted by a diaphragm and voice coil. The housing is divided into two parts by the vibration system. The two parts are usually called front volume and rear volume. However, the only two volumes limit the bandwidth of the frequency of the audio signals. In such a type earphone, the response decreases at frequencies below the resonant frequency of the vibration system and, therefore, the resonant frequency needs to have a low value in order to improve the low frequency characteristic.

In order to avoid the above problems, an improved headphone is configured to be provided with a chamber extending in the housing behind the vibration system. Therefore, the resonant frequency can be lowered irrespective of the compliance and equivalent mass of the vibration system with the result that the characteristic of the earphone in the low frequency range can be improved. However, by providing acoustic resistance material in an opening or openings formed in the housing behind driver unit, a peak appears in the frequency characteristic of the earphone at frequencies of 3 to 5 kHz, that is, a part of the high frequency range is emphasized, so that metallic sounds become overly conspicuous and unpleasant to hear. In other words, the bandwidth of the frequency of the audio signals is restricted in high frequency and low frequency. Intermediate frequency and extra low frequency of the audio signals are lost or are not performed accurately, which affects the sound quality required by the users.

So, it is necessary to provide a new earphone for solving the problems mentioned above.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

Figure 1:
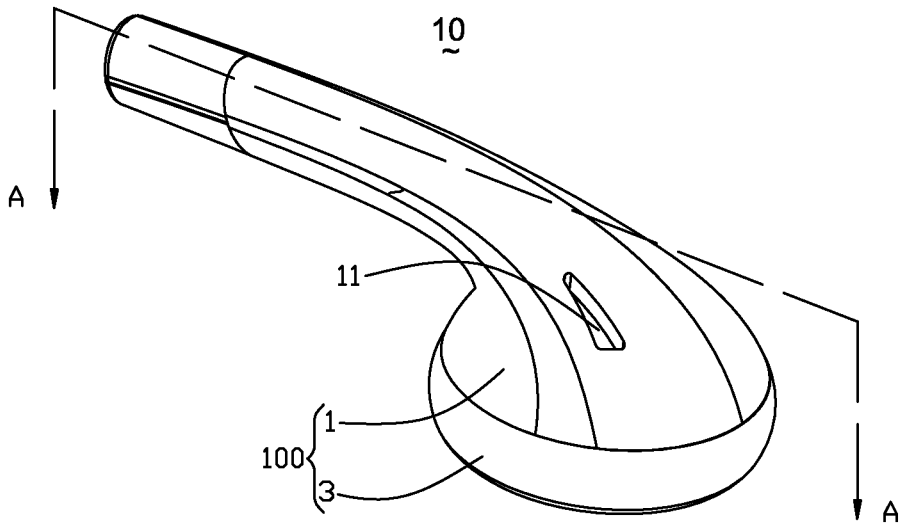
FIG. 1 is an isometric view of an earphone in accordance with an exemplary embodiment of the present disclosure.

While the invention is susceptible of embodiments in many different forms, there is shown in the drawings and will herein be described in detail embodiment of the invention with the understanding that the present disclosure is to be considered as an exemplification of the principles of the invention and is not intended to limit the broad aspect of the invention to the embodiment illustrated.

Figure 2:
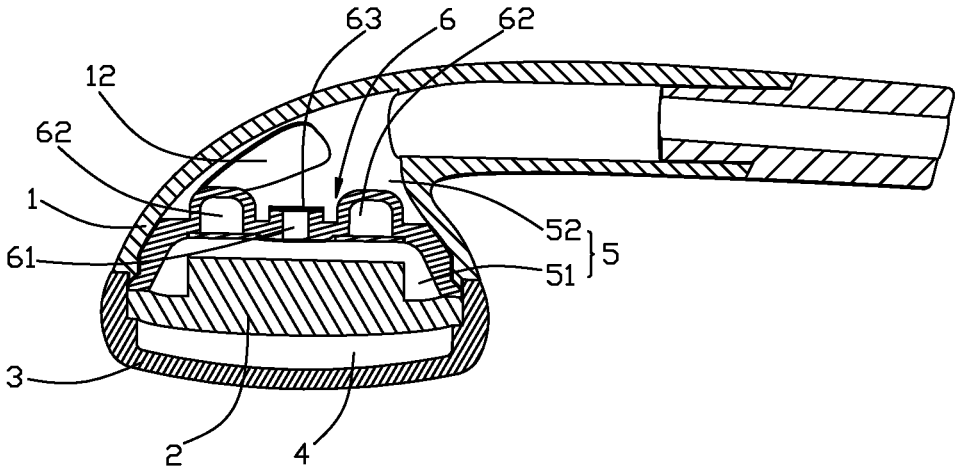
FIG. 2 is a cross-sectional view of the earphone taken along line A-A in FIG. 1.
Figure 3:
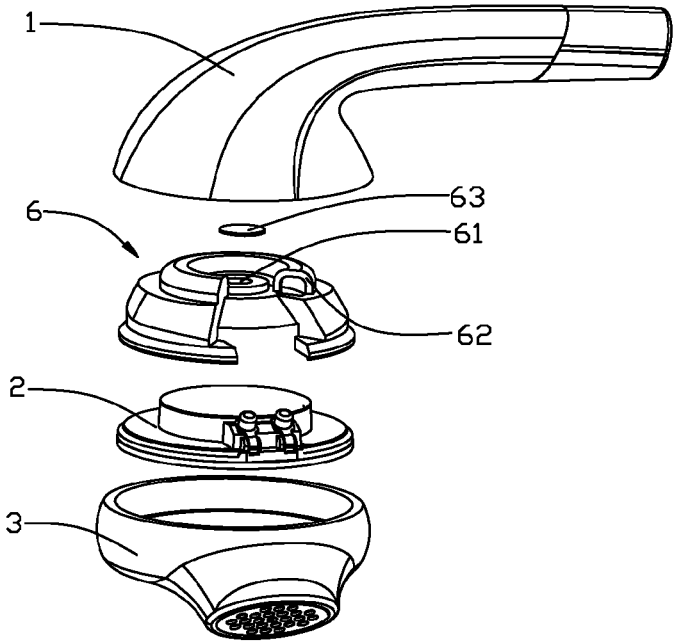
FIG. 3 is an isometric exploded view of the earphone in FIG. 1.

Referring to FIGS. 1 through 3, the exemplary embodiment of the present invention discloses an earphone 10 including a housing 100 forming a volume for accommodating a sound generator 2 therein and a wire for electrically connecting the sound generator 2 to an external device that provides audio signals. In general, the housing 100 includes a plurality of sound holes for transmitting the sound produced by the sound generator to the user's ear. In this embodiment, the housing 100 includes a cover 3 and a case 1 coupled with the cover 3. The cover 3 forms a cavity for accommodating the sound generator 2. Referring to FIG. 1, at least one sound hole 11 is arranged on the case such that it can transmit the sound to outside. FIG. 1 illustrates only one sound hole, but, the amount of the sound hole is not limited to one, and may be adjusted according to actual requirement.

Referring to FIG. 2, which is a cross-sectional view of the earphone in FIG. 1, the sound generator 2 is positioned in the cavity by mechanical connections with the cover 3. A front volume 4 is accordingly formed by the sound generator 2 cooperatively with the cover 3. Furthermore, the case 1 forms a chamber 5 for accommodating a supporter 6 and the sound generator 2 at least partially contained in the supporter 6. The supporter 6 is configured to be like an incomplete bowl mounted on the case 1 and has a hollow space for accommodating the sound generator 2. In other words, the supporter 6 is positioned in the chamber of the case 1 such that it divides the chamber 5 into an auxiliary back volume 52 and a main back volume 51. The supporter 6 is interposed between the main back volume 51 and auxiliary back volume 52 to support the sound generator 2. Furthermore, a first damper 12 is pasted on the case covering the sound hole 11 and accommodated in the auxiliary back volume 52 for balancing an internal acoustic pressure of the earphone 10.

In the present embodiment, the sound generator 2 generally has a magnetic circuit, at least a diaphragm unit corresponding to the magnetic circuit, at least a pair of welding pads for electrically connecting with the diaphragm unit for conducting electrical signals to the diaphragm units. The sound generator is a necessary component to manufacture a finished earphone. The sound generator also can be obtained in the public-known arts.

Figure 4:
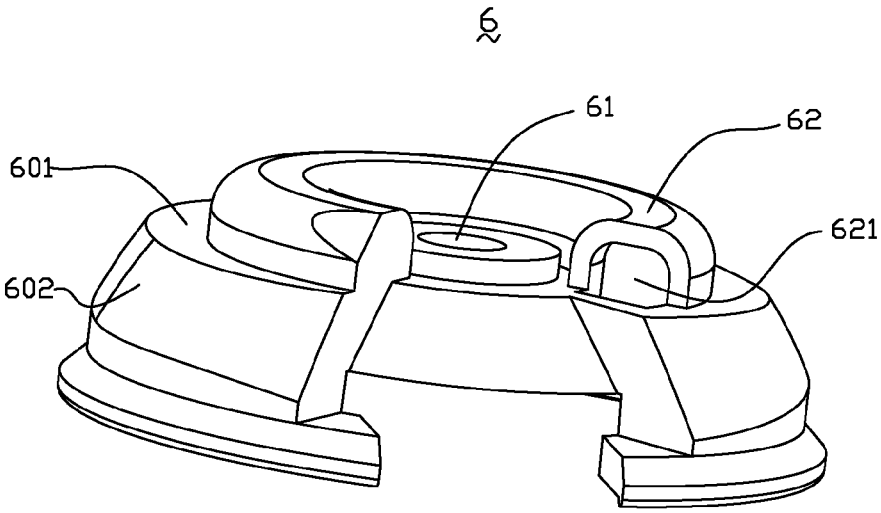
FIG. 4 is an enlarged view of a base frame of the earphone in FIG. 3.
Figure 5:
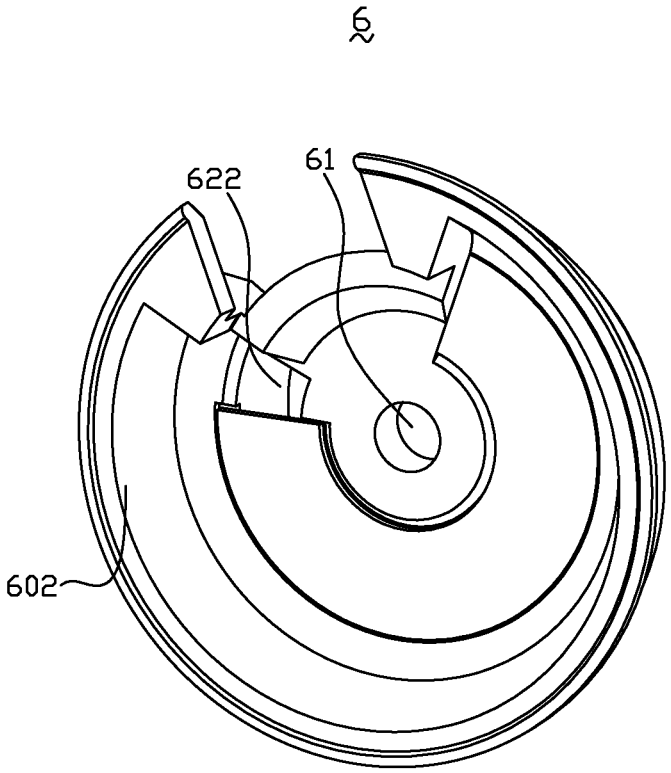
FIG. 5 is an isometric view of the base frame in FIG. 4, from another aspect.

Referring to FIGS. 4 and 5, the supporter 6 is a plastic frame for bolstering the sound generator 2 so as to form the main back volume 51 between the supporter 6 and the sound generator 2. The supporter 6 includes a bottom 601, a sidewall 602 upwardly extending from the bottom 601 and an acoustic pipe 62 arranged on the bottom and far away from the sidewall 602. The bottom further has an aperture 61 formed on the center part of the bottom. The acoustic pipe 62 is in the shape of a loop ring and rounding the aperture 61. The length of the acoustic pipe 62 is at least greater than half the length of the loop ring. In addition, a first hole 621 is located on the end of the acoustic pipe 62 for communicating with the auxiliary back volume 52 and a second hole 622 is located on the other end of the acoustic pipe 62 for communicating with the main back volume 51. That is to say, the acoustic pipe 62 communicates the main back volume 51 with the auxiliary back volume 52 for balancing an internal acoustic pressure of the earphone 10. Referring back to FIG. 2, the earphone further has a second damper 63 covering the corresponding the aperture 61 of the bottom 601 for adjusting the frequency range of the earphone 10.

When assembled, the sound generator 2 is partially received in the hollow space of the supporter 6, and the supporter is contained in the case so as to separate the chamber of the case into two sound volumes for widening the bandwidth of the frequency response of the earphone and improving the sound performance accordingly. Furthermore, the earphone 10 can generate high quality low frequency sound by virtue of the acoustic pipe 62 serving as a damping room. Typically, by virtue of the configuration of the front volume 4, the main back volume 51 and the auxiliary back volume 52, the sound waves produced by the sound generator 2 corresponding to intermediate and low frequency signals in the main back volume 52 are transmitted to the auxiliary back volume 52 via the acoustic pipe 62 and then to the outside of the earphone via the sound hole 11, the sound waves produced by the sound generator 2 corresponding to high frequency signals in the front volume 4 are transmitted to the outside of the earphone. The cooperation between the chamber and the volume broads the bandwidth of the frequency response of the earpiece and improve the sound performance accordingly.

While the present invention has been described with reference to a specific embodiment, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. An earphone, comprising:

a housing forming a volume, and a sound hole arranged in the housing;

a sound generator received in the volume of the housing and cooperatively with the housing forming a front volume;

a supporter accommodated in the volume of the housing and having a bottom, a sidewall upwardly extending from the bottom and an acoustic pipe located on the bottom of the supporter;

a main back volume formed by the bottom of the supporter, the sidewall of the supporter and the sound generator engaging with the sidewall of the supporter, an auxiliary back volume formed by the bottom of the supporter, the sidewall of the supporter cooperatively with the housing;

the acoustic pipe communicating the main back volume with the auxiliary back volume for balancing an internal acoustic pressure of the earphone.

2. The earphone as described in claim 1, wherein the supporter further comprises an aperture formed on the center part of the bottom and a second damper covering the corresponding aperture of the bottom for adjusting the frequency range of the earphone.

3. The earphone as described in claim 1, wherein the acoustic pipe is in the shape of a loop ring.

4. The earphone as described in claim 2, wherein the acoustic pipe is in the shape of a loop ring and surrounding the aperture.

5. The earphone as described in claim 3, wherein the length of the acoustic pipe is at least greater than half the length of the loop ring.

6. The earphone as described in claim 4, wherein the length of the acoustic pipe is at least greater than half the length of the loop ring.

7. The earphone as described in claim 5, wherein a first hole of the acoustic pipe is located on the end of the acoustic pipe for communicating with the auxiliary back volume, and a second hole is located on the other end of the acoustic pipe for communicating with the main back volume.

8. The earphone as described in claim 6, wherein a first hole of the acoustic pipe is located on the end of the acoustic pipe for communicating with the auxiliary back volume, and a second hole is located on the other end of the acoustic pipe for communicating with the main back volume.

9. An earphone, comprising:

a housing defining a cover and a case assembled with the cover, and a sound hole arranged in the housing, the cover having a cavity, the case having a chamber;

a sound generator at least partially received in the cavity of the cover and cooperatively with the cover forming a front volume;

a supporter accommodated in the chamber of the case and dividing the chamber into two parts, the sound generator partially received in one of the parts and engaging with the supporter for forming a main back volume, and the other part being as an auxiliary back volume;

the supporter defining bottom, a sidewall upwardly extending from the bottom and an acoustic pipe mounted on the bottom of the supporter and far away from the sidewall of the supporter, the acoustic pipe communicating the main back volume with the auxiliary back volume for balancing an internal acoustic pressure of the earphone.

10. The earphone as described in claim 9, wherein the supporter further includes an aperture formed on the center part of the bottom and a second damper covered the corresponding the aperture of the bottom for adjusting the frequency range of the earphone.

11. The earphone as described in claim 9, wherein the acoustic pipe is in the shape of a loop ring.

12. The earphone as described in claim 10, wherein the acoustic pipe is in the shape of a loop ring and rounding the aperture.

13. The earphone as described in claim 11, wherein the length of the acoustic pipe is at least greater than half the length of the loop ring.

14. The earphone as described in claim 12, wherein the length of the acoustic pipe is at least greater than half the length of the loop ring.

15. The earphone as described in claim 13, wherein a first hole of the acoustic pipe is located on the end of the acoustic pipe for communicating with the auxiliary back volume, and a second hole is located on the other end of the acoustic pipe for communicating with the main back volume.

16. The earphone as described in claim 14, wherein a first hole of the acoustic pipe is located on the end of the acoustic pipe for communicating with the auxiliary back volume, and a second hole is located on the other end of the acoustic pipe for communicating with the main back volume.

* * * * *